US006402149B1

(12) United States Patent
Chou

(10) Patent No.: US 6,402,149 B1
(45) Date of Patent: Jun. 11, 2002

(54) METHOD OF PLAYING A MAGIC SEVEN CARD GAME

(76) Inventor: Henry H. Chou, 20651 Park Cir., East #2, Cupertino, CA (US) 95014

( * ) Notice: Subject to any disclaimer, the term of this patent is extended or adjusted under 35 U.S.C. 154(b) by 0 days.

(21) Appl. No.: 09/967,393

(22) Filed: Sep. 27, 2001

(51) Int. Cl.[7] ..... A63F 1/00; A63F 9/20
(52) U.S. Cl. ..... 273/292
(58) Field of Search ..... 273/292, 274; 463/11, 12, 13

(56) References Cited

U.S. PATENT DOCUMENTS

| | | | | | |
|---|---|---|---|---|---|
| 5,072,946 | A | * | 12/1991 | Miller | 273/292 |
| 5,265,882 | A | * | 11/1993 | Malek | 273/292 |
| 5,275,415 | A | * | 1/1994 | Wisted | 273/274 |
| 5,314,193 | A | * | 5/1994 | Ferrer | 273/292 |
| 5,895,047 | A | * | 4/1999 | Callahan | 273/292 |

* cited by examiner

*Primary Examiner*—Valencia Martin-Wallace
*Assistant Examiner*—Alex F. R. P. Rada, II

(74) *Attorney, Agent, or Firm*—Raymond Y. Chan; David and Raymond Patent Group

(57) ABSTRACT

A method of playing a 'magic seven' card game which is severed by a house dealer for up to seven players. A special deck of cards containing two Jokers and at least a set of sour-suit cards ranging from Ace to Six. In this game, the value point of each numerical value card, from Two to Six, is counted as its face numerical values. The value point of Ace is counted as 1. The Joker is treated as Ace or Six, i.e. having a point value of 1 or 6. Each player is dealt with two cards as player cards by the house dealer. Each player should bet on at least a 'Hi Gap' spot, a 'Lo Gap' spot or a 'Magic 7' spot before he/she receives the two player cards from the house dealer. Each players inspects his/her player cards by summing up the two value points of the two player cards respectively and then subtracting the summed point value from a reference value point which is 7, to obtain a differential point value. If the player bets on 'Hi Gap' spot and he/she gets a positive differential value, the player has a winning hand. If the player bets on 'Lo Gap' spot and he/she gets a negative differential value, the player has a winning hand. If the player bets on 'Magic 7' spot and he/she gets a differential point of 0, then the player has a winning hand. On top of that, if the player gets two Jokers in one game, the player automatically has a winning hand no matter which spot(s) that he/she has been betted.

20 Claims, 1 Drawing Sheet

METHOD OF PLAYING A MAGIC SEVEN CARD GAME

BACKGROUND OF THE PRESENT INVENTION

1. Field of Invention

The present invention relates to a card game for entertainment or casino, and more particularly to a method of playing a differential number-hitting card game wherein all players do not compete against the house dealer but simply bet whether they will be dealt with a winning hand.

2. Description of Related Arts

Numerous card games have existed where players are dealt with a number of cards and then have an option of receiving additional cards. The goal of which is to score a predetermined number of points but without going over it. A well-known game where the goal is to reach a point value of twenty-one without going over it is 'Black-Jack'.

U.S. Pat. No. 5,072,946 to Miller discloses a casino-type card game involving two players. A card is dealt to each player and when the total number of points is compared, a tie ends the game, or another game is dealt to the player with lower numerical points. The player first reaching a predetermined number of points eventually wins the game. Another U.S. Pat. No. 5,275,415 to Wisted, discloses a 'Black-Jack' type game among a plurality of players playing against each other. The dealer, however, does not receive any cards. U.S. pat. No. 5,265,882 to Malek discloses a casino-type card game wherein a player simultaneously plays at least two of three games against another player. None of these games can compare to the uniqueness of the present invention.

SUMMARY OF THE PRESENT INVENTION

A main object of the present invention is to provide a method of playing a 'magic seven' card game which is easy to play, full of fun and excited. Accordingly, the 'magic seven' card game of the present invention is served by a house dealer for not more than seven players. The method of 'magic seven' card game is a two-card game using a special deck of 50 cards, containing two Jokers and two sets of four-suit cards ranging from Ace to Six, or a special deck of 26 cards, containing two Jokers and one set of four-suit card ranging from Ace and Six. The four suits of cards of each desk can be identified by different face signs which are Spade suit, Heart suit, Club suit and Diamond suit. In this game, the value point of each card is counted from its corresponding face value for cards Two to Six. The point value for Ace is one, whereas each Joker is counted as the value point of an Ace or as a Six i.e. 1 or 6.

To start with, each player is dealt to two cards as player cards by the house dealer who initially shuffles the deck of cards in which the dealer deals. Each player should bet on at least one of a 'Hi Gap' spot, a 'Lo Gap' spot or a 'Magic 7' spot before the player receives the two player cards from the house dealer. Each player should then inspect the two player cards by summing up the value points thereof, so as to achieve a differential point value which is defined by the difference between the summed point value of the two playing cards and a target value 'seven'. If the player bets on the 'Hi Gap' spot, and the summed point value of the two playing cards is 8, meaning the summed point value is higher than the target value '7' for a differential point value of +1, then the player has a winning hand. If the summed point value turns out to be 7, the player has a losing hand except any player who bets on the 'Magic 7' spot. If the player bets on 'Lo Gap' spot, and the summed point value of the two player cards is 6, meaning the summed point value is lower than the target value '7' for a differential point value of −1, then the player has a winning hand. However, when the player gets two Jokers, the player is considered as automatically winning that hand. After each player has inspected his or her two player cards and determined whether he or she is winning or not, the Basic play is completed.

Additionally, the house dealer may also be dealt to three cards for a Bonus play. After the basic play has been completed, each player who has initially betted on the Bonus play can inspect his or her two player cards together with the three cards of the house dealer for whether the five cards match with anyone of a set of predetermined bonus combinations.

BRIEF DESCRIPTION OF THE DRAWINGS

The objects and feathers of present invention, which are believed to be novel, are set forth with particularity in the appended claims. The present invention, both as to its organization and manner of operation, together with further objects and advantages, may best be understood with reference to the following description, taken in reference with the accompanying drawing.

DETAILED DESCRIPTION OF THE PREFERRED EMBODIMENT

Figure 1:
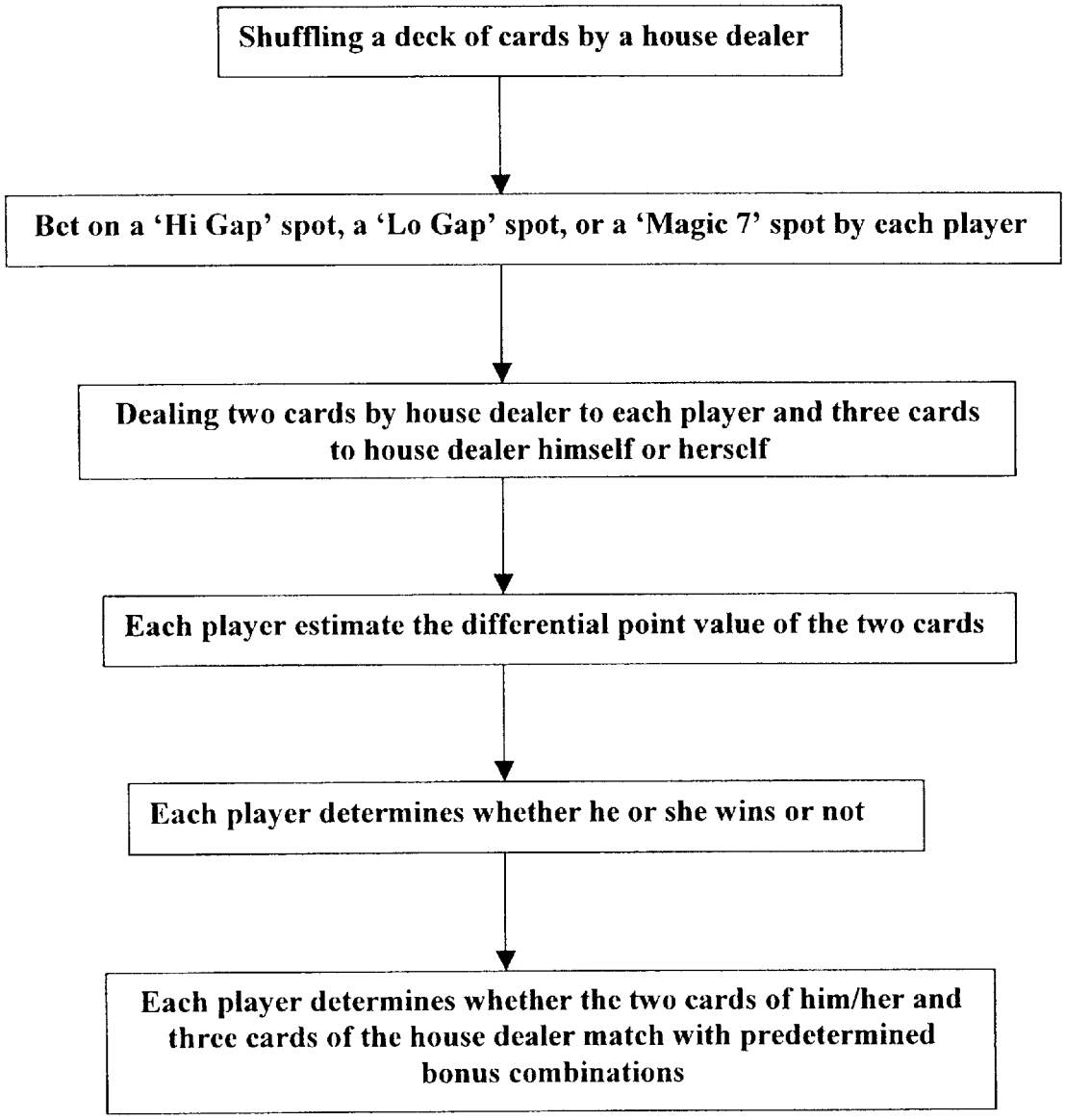
FIG. 1 is a flow chart of a method of playing a 'magic seven' card game according to a preferred embodiment of the present invention, illustrating the steps of a magic seven game.

Referring to the drawing, a 'magic seven' card game for entertainment or casinos is severed by a house dealer for up to seven players. All the players do not compete with the house dealer but simply bet on whether thy will be dealt to a winning hand or not. The card game of the present invention uses a special deck of 50 cards, including two jokers or two designated cards, and two set of four-suit cards ranging from Ace to Six, i.e. Arc, Two, Three, Four, Five and Six. The special deck of cards can also contains 26 cards only, including two Jokers and one set of four-suit cards ranging from Ace to Six. According to the preferred embodiment of the present invention, the four suits are identified as Spade suit, Heart suit, Club suit and Diamond suit. In this game, the value point of each card ranging from Two to Six is exactly the same as the numerical value provided on each card, while the value point of Ace is regarded as 1, and the value point of each Joker is regarded as 1 or 6 as desired by the player and the circumstance of each game.

The 'magic seven' card game of the present invention generally provides a Basic play independently and a Bonus play with respect to the house dealer. The Basic play comprises the following steps:

(1) Initially, the house dealer first shuffles the special deck of cards. Each of the players has the rights to cut the shuffled deck of cards.

(2) Every player should bet on at least one of the following winning spots, including a 'Hi Gap' spot, a 'Lo Gap' spot, and a 'Magic 7' spot, wherein the 'Magic 7' spot means a target value '7', the 'Hi Gap' spot means a positive differential value, and wherein a 'Lo Gap' spot means a negative differential value.

(3) Each player is dealt with two cards as player cards by the house dealer. The house dealer may deal two cards in one time to each player, or in an alternative mode, deal a first card to each player and then a second card to each player. The first card received by each player is preferred to face down and the second card received by each player is preferred to face up. However, both cards can also be dealt in face down condition or in face up condition, depending on the preference and the agreement of the players and the house dealer.

(4) Each player inspects his or her own cards by summing the value points of the two cards and acquires a summed point value. Then, subtract the target value '7' by the summed point value to get a final differential point value. If the player bets on 'Hi Gap' spot and his/her summed point values is higher than the target value '7', for example '12', his/her differential point value is +5 and the player has a winning hand in this case. If the player bets on 'Lo Gap' spot, and his/her summed point value is lower than the target value '7', for example '6', his/her differential point value is −1 and the player also has a winning hand. If the player bets on the 'Magic 7' spot, and if the summed point value of this player is just '7' (e.g. 3 points +4 points), the player has a winning hand. However, when the player has a summed point value of 7, the player has a losing hand if he/she had betted on 'Hi Gap' spot and/or 'Lo Gap' spot. If the player's two received cards contain a Joker, the player can treat the Joker as an Ace or a Six card. If the player gets two Jokers, the player wins automatically in that hand, no matter the player has betted on which spot(s). After each player has inspected his/her own two cards, and has determined whether he/she has won or lost, the Basic play is completed.

(5) After the house dealer has checked the hands of all the players, the house dealer should pay to the winning hand(s) and collect the bet of the losing hand(s), if any. In order to increase the fun of the 'magic seven' card game of the present invention, it is suggested the pay for a successful bet on 'Hi Gap' and 'Lo Gap' differential spots should be the amount of the bet of the corresponding winning player(s). Since the chance of getting a summed point value of 7 (meaning 0 differential point value) is relatively smaller, it is suggested to pay a successful bet on 'Magic 7' spot four times the bet of the corresponding winning player(s). Moreover, since the probability of a player getting both two Jokers is extremely small (0.08163%) for a deck of 50 cards, so it is suggested that the house dealer should pay 70 times of the bet of the winning player who gets both two Jokers.

The following are some examples of winning hands:

| Spot | Winning Hand |
|---|---|
| 'Lo Gap' spot | Ace and Ace<br>Two and Joker (regarded as One) |
| 'Hi Gap' spot | Five and Three<br>Joker (regarded as Six) and Two |
| 'Magic 7' spot | Three and Four<br>Ace (Regarded as One) and Six |

Moreover, in the step (2), a plurality of 'Hi Gap' value spots and 'Lo Gap' value spots can be additionally provided for the players to bet, wherein the 'Hi Gap' value spots include the following:

'Hi-Gap 1' when the summed point value, i.e. '8', is one point higher than the target value '7'.

'Hi-Gap 2' when the summed point value, i.e. '9', is two points higher than the target value '7'.

'Hi-Gap 3' when the summed point value, i.e. '10', is three points higher than the target value '7'.

'Hi-Gap 4' when the summed point value, i.e. '11', is four points higher than the target value '7'.

'Hi-Gap 5' when the summed point value, i.e. '12', is five points higher than the target value '7'.

'Lo-Gap 1' when the summed point value, i.e. '6', is one point lower than the target value'7'.

'Lo-Gap 2' when the summed point value, i.e. '5', is two points lower than the target value '7'.

'Lo-Gap 3' when the summed point value, i.e. '4', is three points lower than the target value '7'.

'Lo-Gap 4' when the summed point value, i.e. '3', is four points lower than the target value '7'.

'Lo-Gap 5' when the summed point value, i.e. '2', is five points lower than the target value '7'.

So that, each player can selectively bet on at least one of the above exact differential winning spots, i.e. the 'Hi-Gap 1', 'Hi-Gap 2', 'Hi-Gap 3', 'Hi-Gap 4', 'Hi-Gap 5', 'Lo-Gap 1', 'Lo-Gap 2', 'Lo-Gap 3', 'Lo-Gap 4', and 'Lo-Gap 5'. For example, if the player betted on 'Hi-Gap 3' and he gets a hand of 'Five and Three' or 'Four and Four', which are summed up to have a summed value point '8', the player wins. However, if he get a hand of 'Two and Four' or 'Ace and Five' that the summed value point is '6', the player loses.

Since the chance of getting a summed point value exactly matches the 'Hi-Gap' or 'Lo-Gap' value spot is also relatively small, it is suggested to pay a successful bet on 'Hi-Gap' value spots and 'Lo-Gap' value spots three times the bet of the corresponding winning player(s).

In addition, the present invention may also require every player to initially bet on the bonus play which is carried on after the basic play is completed. Of course, the bonus play can be a selective choice to each player, but every player has to decide on whether he/she bets on the bonus play or not before the basic play is actually started. If there is any of the players has betted on the bonus spot, the house dealer must be dealt with three cards for bonus play. The house dealer may deal the three bonus play cards before or after dealing to the players. However, it is preferred to deal a facing down first card to the house dealer and then each of the player one by one in an ordered sequence. Then the house dealer should further deal a facing up second card to the house dealer and each of the player one by one again in an ordered sequence. Finally, the house dealer should deal a third card to himself or herself in facing up condition.

After the basic play has been completed, the house dealer should face up all the three bonus play cards and each player who has initially betted on the bonus play can inspect his/her own two cards together with the three bonus cards of the house dealer. If the five cards match with any one of the predefined bonus combinations, the relevant player(s) can collect a bonus pay from the house dealer.

The following are some examples that can be designated as the bonus combinations and the respective suggested payout by the house dealer:

| Bonus Combination | Bonus Pay |
|---|---|
| Four Black Aces (or four Red Aces) and one Joker | 10,000 × bet amount |
| Four Aces (Black or Red) and one Joker | 500 × bet amount |
| Straight Flush | 200 × bet amount |
| Five of a kind | 50 × bet amount |
| Four of a kind | 20 × bet amount |
| Full House | 5 × bet amount |
| Straight | 4 × bet amount |
| Three of a kind | 2 × bet amount |

It is worth to note that three bonus cards are commonly used by every bonus player. Besides, it is possible for the house dealer to designate more bonus combinations. The house dealer is responsible to inspect each player's cards, pay to any winning hand(s) and collect betting from any losing hand(s).

The above description enables any person skilled in the art to make and use the above-mentioned invention and set the best mode of it. Some of the possible modifications derived from the concept of the present invention are illustrated as follows:

(1) The bonus play can be an optional play after the basic play. That is to say, instead of betting on bonus play before the basic play starts, each player is given an option for betting on the bonus play after the basic play is finished. However, in order to enhance excitement of the bonus play, the three cards of the house dealer should only contain one card which is faced up, so that all players don't know what the other two cards are.

(2) The house dealer or the casinos can change the payout amount.

(3) The 'Ace' can be substituted by 'Queen', 'King', 'Jack' or other cards.

In view of the above, the modification mentioned above and other expected or similar modifications derived from the concept of the present invention should be considered as the equivalent embodiments of the present invention.

What is claimed is:

1. A method of playing a 'magic seven' card game, comprising the steps of:

(a) providing at least a house dealer and a player of said card game;

(b) providing at least a deck of cards including two jokers and at least one set of four suits of cards, wherein each of said suits of cards including a 'Ace' card and six numeral value point cards having value points 'one', 'two', 'three', 'four', 'five', and 'six' respectively, wherein said four suits of cards of said deck are identified by different face signs as a Spade suit, a Heart suit, a Club suit, and a diamond suit, wherein said value point of each of said numerical value card is counted as a face numerical value thereof, a value point of each of said Ace cards is counted as 'one', and each of said jokers is counted as a value point of 'one' or 'six';

(c) shuffling said deck of cards;

(d) betting at least a 'Hi Gap' spot, a 'Lo Gap' or a 'Magic 7' spot by said player, wherein said 'Magic 7' spot represents a target value '7', said 'Lo Gap' spot represents that a negative differential value, and said 'Hi Gap' spot represents a positive differential value is positive;

(e) dealing a hand of two cards to said player by said house dealer;

(f) inspecting said two player cards by said player by summing up said value point of each of said two cards to achieve a summed point value and subtracting said target value '7' by said summed point value to obtain a differential point value, wherein when said summed point value is higher than said target value '7', said final differential point value is said positive differential value, and when said summed point value is lower than said target value '7', said final differential point value is said negative differential value;

(g) determining whether said final differential point value is said positive differential value, said negative differential value or a 'zero' value, wherein when said player bets on said 'Hi Gap' spot and said final differential point value of said player is said positive differential value, said player has a winning hand, wherein when said player bets on 'Lo Gap' spot and said final differential point value of said player is said negative differential value, said player has a winning hand, wherein when said player bets on 'Magic 7' spot and said final differential point value is said 'zero' value, said player has a winning hand, and wherein when said player receives said two jokers, said player automatically has a winning hand no matter which spot said player is betted.

2. A method of playing a 'magic seven' card game, as recited in claim 1, wherein said step (e) further comprises an additional step of dealing three bonus play cards to said house dealer, and after step (g), said 'magic seven' card game further comprises a step (h) of checking said two player cards of said player together with said three bonus cards of said house dealer to determine whether said two player cards together with said three bonus cards match with any single combination of a set of predetermined bonus combinations.

3. A method of playing a 'magic seven' card game, as recited in claim 2, wherein in the step (d), a plurality of 'Hi Gap' value spots and 'Lo Gap' value spots are provided for said player to bet, wherein said 'Hi Gap' value spots comprise a 'Hi-Gap 1', a 'Hi-Gap 2', a 'Hi-Gap 3', a 'Hi-Gap 4', and a 'Hi-Gap 5' which represent positive differential point values '+1, '+2, '+3, '+4, and '+5 respectively, and wherein said 'Lo Gap' value spots comprise a 'Lo-Gap 1', a 'Lo-Gap 2', a 'Lo-Gap 3', a 'Lo-Gap 4', and a 'Lo-Gap 5' which represent negative differential point values '−1, '−2', '−3, '−4, and '−5 respectively.

4. A method of playing a 'magic seven' card game, as recited in claim 3, wherein in the step (g), when said final differential point value exactly equal to one of said positive differential point values or said negative point values of said 'Hi Gap' value spots and said 'Lo Gap' value spots that said player betted in the step (d), said player has a winning hand.

5. A method of playing a 'magic seven' card game, as recited in claim 4, wherein in step (e), one of said two playing cards is dealt facing up, and said another playing card is dealt facing down, moreover, at least one of said three bonus play cards is dealt facing down and said other two bonus play cards are dealt facing up.

6. A method of playing a magic seven game, as recited in claim 5, wherein step (d) further comprises an additional step of betting on bonus spot.

7. A method of playing a magic seven game, as recited in claim 4, wherein two set of said sour suits of cards are used.

8. A method of playing a magic seven game, as recited in claim 7, wherein said predetermined bonus combinations comprise four said Ace cards and one said joker card, a straight flush, a five of a kind, a flush, a four of a kind, a full house, a straight, and a three of a kind.

9. A method of playing a magic seven game, as recited in claim 4, wherein step (d) further comprises an additional step of betting on bonus spot.

10. A method of playing a magic seven game, as recited in claim 9, wherein said predetermined bonus combinations comprise four said Ace cards and one said joker card, a straight flush, a five of a kind, a flush, a four of a kind, a full house, a straight, and a three of a kind.

11. A method of playing a 'magic seven' card game, as recited in claim 3, wherein in step (e), one of said two playing cards is dealt facing up, and said another playing card is dealt facing down, moreover, at least one of said three bonus play cards is dealt facing down and said other two bonus play cards are dealt facing up.

12. A method of playing a 'magic seven' card game, as recited in claim 2, wherein in step (e), one of said two playing cards is dealt facing up, and said another playing card is dealt facing down, moreover, at least one of said three bonus play cards is dealt facing down and said other two bonus play cards are dealt facing up.

13. A method of playing a magic seven game, as recited in claim 2, wherein step (d) further comprises an additional step of betting on bonus spot.

14. A method of playing a 'magic seven' card game, as recited in claim 1, wherein in the step (d), a plurality of 'Hi Gap' value spots and 'Lo Gap' value spots are provided for said player to bet, wherein said 'Hi Gap' value spots comprise a 'Hi-Gap 1', a 'Hi-Gap 2', a 'Hi-Gap 3', a 'Hi-Gap 4', and a 'Hi-Gap 5' which represent positive differential point values '+1, '+2, '+3, '+4, and '+5 respectively, and wherein said 'Lo Gap' value spots comprise a 'Lo-Gap 1', a 'Lo-Gap 2', a 'Lo-Gap 3', a 'Lo-Gap 4', and a 'Lo-Gap 5' which represent negative differential point values '−1, '−2', '−3, '−4, and '−5 respectively.

15. A method of playing a 'magic seven' card game, as recited in claim 14, wherein in the step (g), when said final differential point value exactly equal to one of said positive differential point values or said negative point values of said 'Hi Gap' value spots and said 'Lo Gap' value spots that said player betted in the step (d), said player has a winning hand.

16. A method of playing a 'magic seven' card game, as recited in claim 15, wherein in step (e), one of said two playing cards is dealt facing up and said another playing card is dealt facing down.

17. A method of playing a magic seven game, as recited in claim 15, wherein two set of said sour suits of cards are used.

18. A method of playing a 'magic seven' card game, as recited in claim 14, wherein in step (e), one of said two playing cards is dealt facing up and said another playing card is dealt facing down.

19. A method of playing a 'magic seven' card game, as recited in claim 1, wherein in step (e), one of said two playing cards is dealt facing up and said another playing card is dealt facing down.

20. A method of playing a magic seven game, as recited in claim 1, wherein two set of said sour suits of cards are used.

* * * * *